US005791506A

United States Patent [19]

Sheffler et al.

[11] Patent Number: 5,791,506

[45] Date of Patent: Aug. 11, 1998

[54] SEALING CONTAINER WHICH INCLUDES A TWO-PART CAP FOR DISPLAYING A COSMETIC PRODUCT

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 677,342

[22] Filed: Jul. 2, 1996

[51] Int. Cl.[6] ..... B65D 41/04

[52] U.S. Cl. ..... 215/345; 215/341; 215/343; 220/255

[58] Field of Search ..... 215/341, 342, 215/343, 345, 346, 233, 318, 352; 220/255, 256

[56] References Cited

U.S. PATENT DOCUMENTS

| | | | |
|---|---|---|---|
| 637,981 | 11/1899 | Weissenthanner | 215/352 X |
| 730,500 | 6/1903 | Weir | 215/345 |
| 1,152,107 | 8/1915 | Kerr | 215/352 X |
| 1,396,723 | 11/1921 | Burns | 215/233 X |
| 1,832,669 | 11/1931 | Thomas | 215/341 X |
| 2,116,421 | 5/1938 | Williams | 215/352 X |
| 3,172,559 | 3/1965 | Thompson | 220/256 |
| 3,428,208 | 2/1969 | Kosar | 215/341 X |
| 4,106,655 | 8/1978 | Heijting | 215/341 |
| 4,109,815 | 8/1978 | Collins, III | 215/341 X |
| 4,308,965 | 1/1982 | Dutt | 215/345 |
| 4,585,135 | 4/1986 | Sinnott | 215/329 |
| 4,697,716 | 10/1987 | Mumford | 215/341 X |
| 4,747,500 | 5/1988 | Gach et al. | 220/258 X |

FOREIGN PATENT DOCUMENTS

| | | | |
|---|---|---|---|
| 222664 | 7/1959 | Australia | 215/341 |
| 344458 | 11/1904 | France | 215/341 |
| 1010048 | 6/1952 | France | 215/341 |
| 99948 | 4/1989 | Japan | 215/341 |
| 22002 | 2/1912 | Norway | 215/341 |
| 1131419 | 10/1968 | United Kingdom | 215/341 |

*Primary Examiner*—Allan N. Shoap
*Assistant Examiner*—Robin A. Hylton
*Attorney, Agent, or Firm*—H. Gibner Lehmann; K. Gibner Lehmann

[57] ABSTRACT

A display-type container for cosmetics and the like, includes a flat jar having a neck portion with an external screw thread, and a ring-shaped screw cap member that is mounted on and cooperable with the neck portion. The latter has an annular sealing lip, and a plastic panel member which is disposed in the ring-shaped screw cap member provides underside sealing areas or surfaces that are engaged with the sealing lip. Portions of the screw-cap member and panel member are disposed in overlying relation, the two members being centralized with one another, and forming a unitary closure assemblage. The arrangement is such that the sealing areas of the panel member are forced by the screw cap member, into substantially air-tight sealing engagement with the sealing lip of the jar. The seal does not depend on the engagement of the threads, or upon any incidental sealing therebetween, which may or may not occur. The panel member is preferably transparent, to permit viewing of the jar contents, and the screw cap is preferably opaque, to largely conceal its own thread, and that of the jar.

8 Claims, 3 Drawing Sheets

28
22d
68
20d
48
14d
44
40d
42
38
46d
30d
72
70
18d
12d 28
20c
48
14c
44
40c
42
38
46c
30c
64
22c
18c
12c 28
32b
20b
48
14b
44
40b
42
38
46b
30b
36b
60
62
22b
18b
12b 94
106a
98
88
84
80a
104
110
112
92a
87
86
96
82

94
100
88
84
80
104
110
92
96
82
86
90

SEALING CONTAINER WHICH INCLUDES A TWO-PART CAP FOR DISPLAYING A COSMETIC PRODUCT

CROSS REFERENCES TO RELATED APPLICATIONS

1. Co-pending application U.S. Ser. No. 08/558,811, filed Nov. 15, 1995, entitled COSMETIC JAR AND STORAGE DEVICE, and having common ownership with the present application.

2. Co-pending application U.S. Ser. No. 08/620,221, filed Mar. 22, 1996, entitled COSMETIC JAR AND STORAGE DEVICE, and having common ownership with the present application.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to plastic jars, and more particularly to jars of the type utilized to store cosmetic materials, or substances of a type where a hermetic seal is required in order to preserve or protect the efficacy of the contained material or substance.

2. Description of the Related Art Including Information Disclosed Under 37 CFR §§1.97–1.99

The following references are hereby made of record, as being of interest in the technical field of the invention:

U.S. Pat. Nos.: 209,813 326,492 597,083 748,642 893,008 997,505 1,516,129 1,700,958 3,428,208 3,111,237 3,428,208 4,834,824

Considering the references chronologically, U.S. Pat. No. 209,813 discloses a container having a lip provided with an annular external groove, and a gasket or packing received in the groove. The container's cover has a depending annular ring which fits into the groove and engages the packing to form a seal of the contents.

U.S. Pat. No. 326,492 involves a jar having a lip with an annular recess, and a closure cap having a circular, downwardly extending edge. A rubber band is fitted into the recess. The edge of the cap, when assembled to the jar, compresses the band against the walls of the recess so as to form a seal.

U.S. Pat. No. 597,083 shows a container having a lip with an upwardly-facing annular recess, and a two-part cover comprising a metallic shell and a liner. The latter has a downwardly-facing recess adapted to overlie the lip recess. A gasket is disposed in the container lip recess, and experiences compression when the cover is assembled to the container.

U.S. Pat. No. 748,642 relates to a jar and closure therefor, the jar having an upwardly-facing annular groove, and the underside of the closure having a peripheral, depending bead. A sealing gasket is engaged by the bead and forced into the groove, so as to establish a seal between the closure and jar.

U.S. Pat. No. 893,008 relates to a bottle and stopper member, wherein the bottle has an annular groove at its mouth, cooperable with a rib on the underside of the stopper member. Interposed between the latter and lip is a gasket constituted of paper or cork.

U.S. Pat. No. 997,505 illustrates a somewhat different arrangement, wherein an annular groove is provided in a closure cap for a bottle, and the wall of the neck of the bottle has a tapered or pointed cross-sectional configuration, arranged to engage and deform a sealing gasket located between the groove walls and the tapered wall of the bottle neck when the cap is assembled thereto.

U.S. Pat. No. 1,516,129 illustrates a construction similar to those of several of the previous patents, namely a jar having a lip with an upwardly-facing annular groove, and a sealing gasket placed in the groove. The cover has a depending outer wall receivable in the groove, so as to compress the gasket and seal the jar.

U.S. Pat. No. 1,700,958 also discloses a sealed container utilizing a gasket, and a depending circular flange on a cover for the container, the flange engaging the gasket when the cover is assembled.

U.S. Pat. No. 3,111,237 discloses a molded sealing gasket constituted of plastisol, deposited in a molten state, in a groove of a foil that is ultimately used as a liner on the underside of a cap. FIGS. 10 and 13 illustrate the general idea.

U.S. Pat. No. 3,428,208 involves a somewhat different concept, namely that of providing a variety of interengaging surfaces between a container and cover therefor, without the use of a gasket.

U.S. Pat. No. 4,834,824 illustrates a method of forming a gasket of predetermined outline by deposition of molten elastomer on a flat surface of a release board assembly. The latter is subsequently utilized to transfer the formed gasket to a workpiece. The arrangement has application in securing automotive windows in position and with the sealant disposed between the respective window and window frame member.

It is considered that few, if any, of the above-identified container arrangements have had significant impact in the market-place, and accordingly there has existed a long-felt need for a container construction which could be successfully employed to store and dispense a wide variety of cosmetic preparations, such as skin creams, blushers, mascaras, eyeliners, eyeshadows, and/or lipsticks and lip liners. The use of conventional compressed paperboard, or foamed plastic or multi-composition laminated sealing sheets between the lip of a container and the underside of a closure therefor, has been found to be unacceptable in many cases, especially where the required seal area is large, as for example, the entire circular undersurface of the closure.

Also, sealing liners which were merely pressed into the closure of a container were unsuited for applications where the contents of the container were intended to be viewed, while the container was still in an unopened or sealed condition.

SUMMARY OF THE INVENTION

Accordingly, the above disadvantages and drawbacks of prior cosmetic-type containers are largely obviated by the present invention which has for one object to provide a novel and improved display-type container which is simple in its structure and which features an essentially completely air-tight or hermetic seal of the container contents, so as to avoid inadvertent evaporation or contamination thereof.

Another object of the invention is to provide an improved display-type container as above indicated, which effectively isolates the container contents from the area around the cooperable screw threads on the container jar and closure therefor, thereby minimizing any tendency for product to accumulate or collect, and thereafter harden. Such a condition is not only unsightly, but also can interfere with smooth opening and closing of the container in the event of a residue build-up on or near the threads.

A related object of the invention is to provide an improved display-type container as above characterized, which is largely resistant to chemical attack as from the contents, by virtue of the elimination of cap liners and the like which do not tolerate well, organic-solvent-base compositions of a type that are currently being utilized in the cosmetic field.

Still another object of the invention is to provide an improved display-type container of the kind indicated, which permits the contents to readily viewed from above the container closure, as through a transparent plastic window, while at the same time completely concealing cooperable thread formations on the container neck and closure, which would otherwise be visible and detract from the overall appearance of the container. Such a consideration is important from the commercial and marketability standpoint, especially in today's consumer-oriented environment.

Yet another object of the invention is to provide an improved display-type container as above set forth, wherein the individual components can be readily molded in simple mold cavities, and at reduced manufacturing/assembly cost.

A still further object of the invention is to provide an improved display-type container in accordance with the foregoing, which can be easily held in the hand and manipulated, thereby rendering the device user-friendly.

Yet a further object of the invention is to provide an improved display-type container of the type noted, which is aesthetically pleasing and eye-catching in its overall appearance, this further enhancing the marketability of the item.

In accomplishing the above objects the invention provides a display-type container for cosmetics and the like, comprising in combination, a low, flat jar having a wide annular neck portion provided with an external screw thread, the neck portion having a mouth constituting a continuous sealing lip, and a ring-shaped screw cap member that is carried on and cooperable with the neck portion. The screw cap member has an internal screw thread that engages the external screw thread of the jar neck portion. In addition, there is provided a plastic panel member disposed in the ring-shaped screw cap member, the panel member having underside sealing areas which are engaged with the sealing lip of the neck portion. Peripheral portions of the ring-shaped screw-cap member are disposed in overlying relation with peripheral portions of the panel member. The arrangement is such that the cooperable overlying portions force the sealing areas of the panel member into tight sealing engagement with the continuous sealing lip of the jar.

Where the panel member is constituted of transparent plastic material, the member assumes the function of a window, enabling the contents of the jar to be readily viewed prior to opening. Also, in a preferred form the screw cap member is constituted of opaque plastic material, which permits a complete concealment of its own screw thread as well as that of the jar.

By establishing the sealing function between solely the jar lip and the panel member of the closure, no product leakage into the area of the threads occurs. There is thus eliminated the need for cap liners, expansive sheet-type gaskets, and the like, as typically were required in many prior container designs.

The arrangement is such that the panel member, when constituted of transparent material and thus functioning as a lens or window, at the same time serves as a functional component of the sealing mechanism, which latter is remote with respect to the location of the closure thread and jar thread.

Other features and advantages will hereinafter appear.

BRIEF DESCRIPTION OF THE DRAWINGS

In the drawings, illustrating several embodiments of the invention.

DESCRIPTION OF THE PREFERRED EMBODIMENTS

Figures 1, 2, 3:
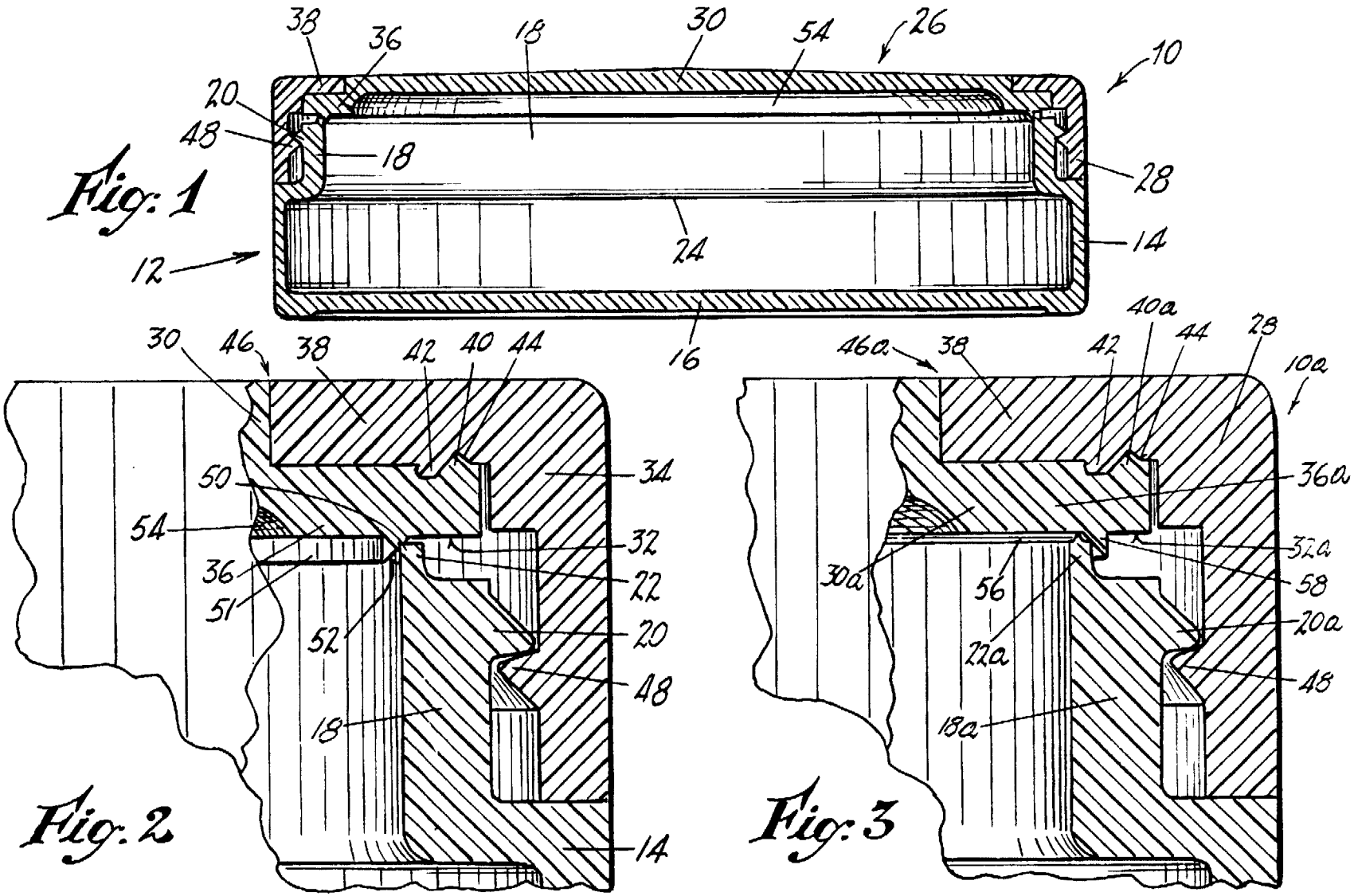
FIG. 1 is an axial section of the improved display-type container of the present invention, comprising a jar and closure therefor.
FIG. 2 is a fragmentary axial section, greatly enlarged, of the container of FIG. 1.
FIG. 3 is a fragmentary axial section similar to FIG. 2, of a modified container, constituting another embodiment of the invention.

Referring first to FIGS. 1 and 2 there is illustrated a container for cosmetics or other material, designated generally by the numeral 10 and comprising essentially a low, flat jar 12 having an annular side wall 14, a transverse bottom wall 16, and a wide neck portion 18 with an external screw thread 20, the neck portion having a mouth comprising a lip 22. The neck portion 18 meets the side wall 14 at an internal shoulder 24.

In accordance with the present invention there is provided a novel and improved sealing closure 26 for the jar 12, comprising the combination of a ring-shaped screw cap member or cap part 28 that is receivable on and cooperable with the neck portion 18, and a plastic panel member or disk-shaped panel 30 that is disposed in the ring-shaped screw cap member 28, the panel member 30 having underside sealing areas 32 which are engageable with the lip 22 of the neck portion 18 of the jar 12, to provide a hermetic seal therewith.

Referring to FIG. 2, in carrying out the sealing function, the periphery or peripheral portions 34 of the ring-shaped screw cap member 28 are disposed in overlying relation with the periphery or peripheral portions of the panel member 30, such that the underside sealing areas 32 of the panel member 30 are brought into essentially completely air-tight or hermetic sealing engagement with the jar lip 22.

With the closure 26 being constituted of two pieces, as noted, according to the invention the actual sealing occurs solely between the panel member 30 and jar lip 22, with the periphery 34 of the screw cap member 28 lying radially outside of the sealing area and as such, not participating in the sealing function except to retain the pressure of the panel member 30 on the jar lip 22.

The uppermost surface of the panel member 30 is preferably smooth, having a slight convex configuration as in FIG. 1. The panel member 30 has a peripheral annular shoulder 36 which is abutted by and secured to a corresponding, mating annular seat or shoulder 38 of the screw cap member 28. Optionally, interengaging annular positioning beads 40, 42 are provided on the adjoining surfaces of the panel member 30 and screw cap member 28 respectively, as shown, to maintain the two members in alignment during the useful life of the container. The bead 40 is received in a groove 44, as shown. Sealing and retainer means are utilized in securing the panel member 30 and screw cap member 28 together, such as ultrasonic welding, adhesives, or the like, which are per se known in the art. The arrangement is preferably such as to provide a smooth, stepless transition or joint 46 between the upper surface of the panel member 30 and screw cap member 28, as in FIG. 2. Here, the adjoining surfaces are essentially smooth continuations of one another.

The peripheral portions 34 of the screw cap member 28 have an internal thread 48, to mate with the neck portion thread 20 in the usual manner.

Referring again to FIG. 2, the jar lip 22 has an upstanding skirt 50 of reduced cross-sectional configuration, and the underside sealing area 32 of the panel member 30 is provided with a cooperable depending skirt 51 having a generally conical frustum surface 52 which seats and seals against the upstanding skirt 50 of the jar lip 22 when the screw cap member 28 is tightened, as in the figure. It is to be especially noted that with the disclosed construction, an air-tight or hermetic seal is established at the location of the jar lip 22, and that substantially no portions of the screw cap member 28 per se, participate in the sealing function. Stated differently, the seal is established solely between the one-piece, molded panel member 30 and the jar lip 22. As a consequence, the joint 46 between the screw cap member and panel member 30, along the shoulders 36 and 38, is not involved with the seal, to the end that any slight inconsistencies at the joint 46 will not jeopardize the seal that has been established between the one-piece, molded panel member 30 and lip 22.

In a preferred embodiment, the panel member 30 can be made of transparent plastic material, which enables the contents (not shown) of the jar 12 to be viewed when the jar is closed, as during display in a cosmetic counter at a store or salon. Also, the screw cap member 28 is preferably constituted of opaque plastic material, as is the jar 12, which latter may be either a single-walled construction similar to that shown, or a double-wall type (not shown) that is frequently utilized in present day packaging.

The underside surface 54 of the panel member 30 is preferably concave, so as to reduce the quantity of plastic utilized, and to maximize transparency.

The distinct advantage provided by the disclosed construction lies in the fact that the transparent panel member 30 not only facilitates inspection of the container contents, but in addition is solely responsible for the seal with the jar lip 22. As noted, the seal is thus accomplished between solely two molded components, each of which is integral in and of itself and thus air-tight, namely the jar 12, and the panel member 30. The opaque nature of the screw cap member 28 has a distinct advantage from the aesthetics standpoint, since it fully conceals the thread 20 of the jar neck portion 18, as well as concealing its own internal thread 48. In accomplishing the concealment, the overlying shoulder 38 of the screw cap member 28 extends radially inwardly of the jar lip 22, such that the latter, being opaque, hides the cooperable threads 20, 48 even if the jar is viewed from above and where the viewer looks through the transparent panel member 30 at an angle. All that is visible is the product itself (not shown), and the inner surfaces of the side wall 14 of the jar 12 and its neck portion 18.

Another embodiment of the invention is illustrated in FIG. 3, showing a somewhat modified container and sealing arrangement therefor. Like reference numerals have been assigned to parts corresponding to those of the embodiment of FIGS. 1 and 2, with a suffix "a" added, where appropriate.

In FIG. 3, the container **10*a* comprises a jar having a lip 22*a* provided with an upstanding skirt terminating in an upwardly-facing, reduced dimension annular sealing bead 56 which cooperates with the underside sealing surface or area 32*a* of a modified panel member 30*a*. The latter is provided with a depending skirt 58 having a conical frustum interior surface as shown, which sealingly engages the bead 56 of the jar lip 22*a*. Both the bead 56 and the skirt 58** are resilient, so as to accommodate slight irregularities which may occur in the parts, following curing.

The embodiment of FIG. 3 is, in other respects, similar to that of FIGS. 1 and 2. Cooperable threads **20*a* and 48 on the jar and screw cap member 28 are provided. The jar has an annular side wall, and a neck portion 18*a*. The panel member 30*a* has a peripheral annular shoulder 36*a* which abuts a corresponding annular shoulder 38 of the screw cap member 28. Interengaging annular positioning beads 40*a*, 42 are provided on the adjoining surfaces of the panel member 30*a* and screw cap member 28 respectively, to maintain the two members in alignment. The bead 40*a* is received in a groove 44, as before. The members 30*a* and 28 are secured by suitable means, such as adhesive or ultrasonic welding, and a smooth, step-free transition or joint, as at 46*a* is thus realized between the upper surface of the member 30*a* and the adjoining surface of the screw cap member 28 as shown in FIG. 3**.

Figures 4, 5, 6, 7, 10:
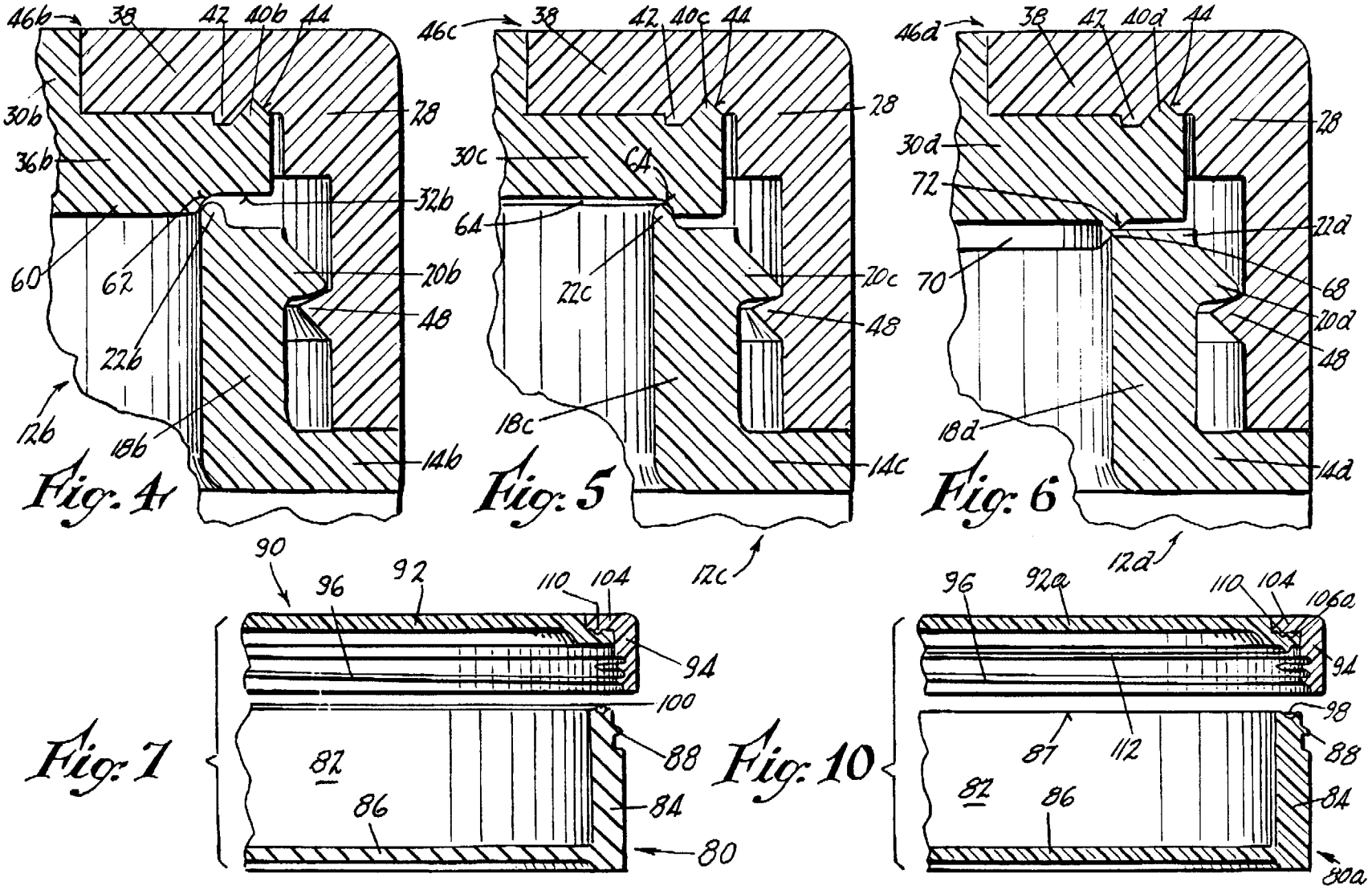
FIG. 4 is a fragmentary axial section similar to FIGS. 2 and 3, of a further modified container, constituting still another embodiment of the invention.
FIG. 5 is a fragmentary axial section similar to FIGS. 2–4, of a still further modified container, constituting yet another embodiment of the invention.
FIG. 6 is a fragmentary axial section similar to FIGS. 2–5, of yet another modified container, constituting still another embodiment of the invention.
FIG. 7 is a fragmentary axial section similar to FIG. 1, of still another modified container, constituting yet another embodiment of the invention.
FIG. 10 is a fragmentary axial section similar to FIG. 7, of yet another modified container, constituting still another embodiment of the invention.

Still another embodiment of the invention is illustrated in FIG. 4, showing a further modified jar **12*b* having a lip 22*b*, comprising an upstanding bead formation of generally rounded contour, and wherein the panel member 30*b* is provided with a thickened central portion or downwardly facing plateau 60, the peripheral edge 62 of which is rounded or a conical frustum, and which seats against and sealingly engages the rounded bead contour of the jar lip 22*b***.

In other respects the container is similar to that of the embodiment of FIG. 3. There are provided cooperable threads 20b and 48 on the jar 12b and screw cap member 28. The jar has an annular side wall 14b, and a neck portion 18b. The panel member 30b has a peripheral annular shoulder 36b which abuts a corresponding annular shoulder 38 of the screw cap member 28. Positioning beads 42, 40b facilitate initial alignment of the two members, with bead 40b being received in groove 44, as before. The members 30b and 28 are secured by adhesive or ultrasonic welding, and a smooth, step-free transition or joint, as at 46b is thus realized between the upper surface of the member 30b and the adjoining surface of the screw cap member 28 as shown in FIG. 4.

Yet further embodiments of the invention are shown respectively in FIGS. 5 and 6.

FIG. 5 illustrates a modified jar 12c having a lip 22c comprising an upstanding bead formation of generally rounded contour, and wherein the panel member 30c is provided with an inwardly-facing peripheral edge 64 which is rounded or a conical frustum, and which seats against and sealingly engages the rounded bead formation of the jar lip 22c. The threads on the jar 12c and screw cap member 28 are designated 20c and 48, respectively. The jar has an annular side wall 14c and a neck portion 18c. The panel member 30c has a peripheral annular shoulder which abuts and is connected to a corresponding annular shoulder 38 of the screw cap member 28. Positioning beads 40c, 42 maintain the initial alignment, the bead 40c being received in groove 44. The members 30c and 28 are secured by adhesive or ultrasonic welding, and a smooth, step-free transition or joint, as at 46c, is thus realized between the upper surface of the panel member 30c and the adjoining surface of the screw cap member 28 as shown.

In the containers of both FIGS. 4 and 5, the respective sealing elements such as 22b and 62 of FIG. 4, are resilient so as to accommodate any inconsistencies stemming from molding of the panel member or jar.

In FIG. 6, there is illustrated a jar 12d having a lip 22d which is squared in cross section. The lip has a sharp inner edge which is adapted to bear against a conical frustum surface 72 of a cooperable depending sealing bead 70 of the panel member 30d. Cooperable threads 20d and 48 on the jar 12d and screw cap member 28 respectively are provided, as in the first embodiment. The jar has an annular side wall 14d and a neck portion 18d. The panel member 30d has a peripheral annular shoulder which abuts a corresponding annular shoulder 38 of the screw cap member 28. Beads 40d, 42 are provided, as in the previous construction, with bead 40d being received in a groove 44. A smooth, step-free transition or joint, as at 46d, is thus realized between the upper surface of the panel member 30d and the adjoining upper surface of the screw cap member 28 as shown.

As in the previously described arrangements, in FIG. 6, the seal that occurs is solely between the panel member 30d and the jar lip 22d, with the screw cap member serving essentially to press the panel member against the lip. The options involving transparency of the panel member and opacity of the screw cap member are applicable to all of the embodiments shown respectively in FIGS. 4, 5 and 6.

Figure 9:
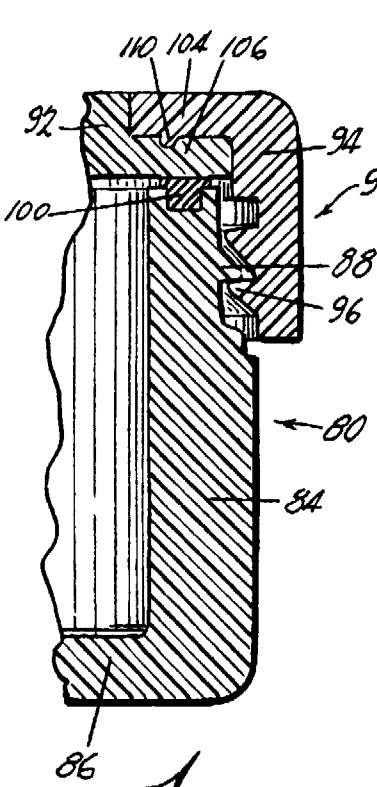
FIG. 9 is a fragmentary axial section of the container of FIGS. 7 and 8, with the closure installed fully on the jar.
Figure 8:
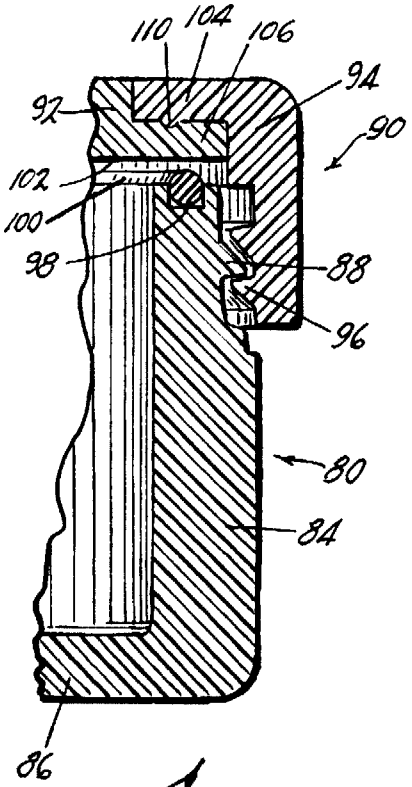
FIG. 8 is a fragmentary axial section of the container of FIG. 7, with the closure loosely carried on the jar.
Figure 13:
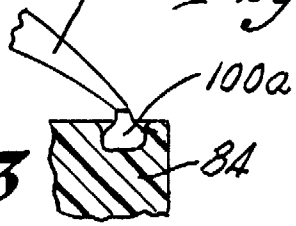
FIG. 13 is a fragmentary section of the jar of FIGS. 10–12 showing the groove of the lip thereof as it is being filled with liquid gasket material, through a nozzle that is connected to a liquid reservoir.

Still another embodiment of the invention is illustrated in FIGS. 7–9, showing a display-type container of modified construction, generally designated by the numeral 80. The container comprises a jar 82 having an annular side wall 84 and a transverse bottom wall 86. The jar 82 has a neck portion provided with an external screw thread 88, and a cooperable closure 90 comprising a central panel member 92 and a peripheral screw cap member 94. The screw cap member has an internal thread 96 which mates with the jar thread 88 in the usual manner.

In accordance with the present invention, the jar side wall 84 has an annular sealing lip provided with a groove 98 which can be of either rectangular or round configuration and which receives a sealing gasket 100 of resilient plastic, rubber, or elastomer composition. In a preferred embodiment, the gasket 100 can be preformed to the proper dimension, as a separate molded article, and thereafter pressed into the groove 98 to as to remain captive therein. Under such circumstances, when the closure 90 comprising the panel member 92 and screw cap member 94 is assembled to the jar 82, the gasket 100 is compressed and elastically deformed, so as to provide an air-tight or hermetic seal between the jar lip and the panel member 92. The panel member 92 has an underside sealing surface 102 which is adapted to sealingly engage and compress the gasket 100 as shown in FIG. 9 when the closure 90 is assembled to the jar 82.

As in the previous embodiment, the screw cap member 94 per se, is not involved with the seal other than to maintain the pressure on the panel member 92, and the sealing engagement between it and the gasket 100. The screw cap member 94 has a flange or shoulder 104 which overlies a corresponding shoulder 106 on the panel member 92 so as to maintain the members in assembled relation. A positioning bead 110 is optionally provided, on one or the other of the shoulders 104, 106.

FIG. 8 shows the gasket 100 prior to installation of the closure, and FIG. 9 illustrates the gasket 100 after it has been compressed by the panel member 92.

The panel member 92 is preferably constituted of transparent plastic, whereas the screw cap member 94 is preferably opaque, so as to conceal from view, its own screw thread 96 as well as the thread 88 on the jar exterior. In the embodiment of FIGS. 7–9, the flange of the screw cap member 94 extends radially inwardly past the jar wall, such that the container, when viewed from above, reveals solely the jar contents and the side wall 84 of the jar, which are seen through the transparent panel member 92. By contrast, the area occupied by the screw threads 88, 96 is substantially completely concealed from view when the closure is assembled to the jar.

Figure 12:
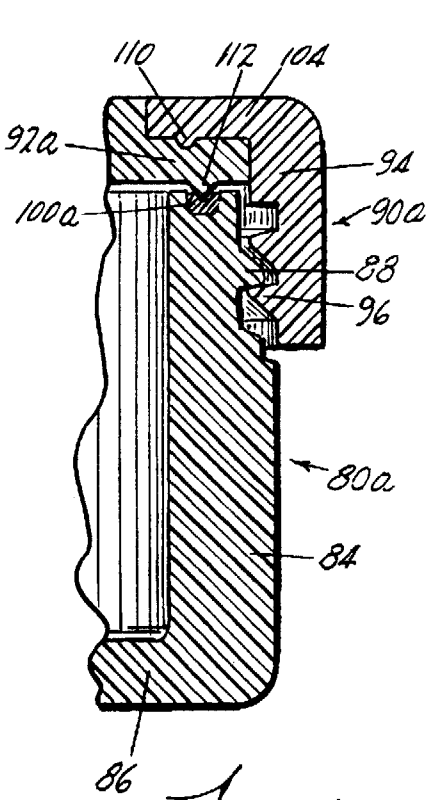
FIG. 12 is a fragmentary axial section of the container of FIGS. 10 and 11, with the closure installed fully on the jar.
Figure 11:
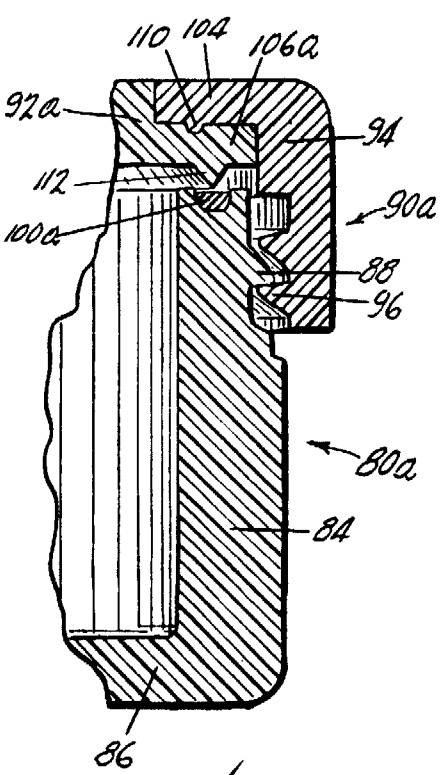
FIG. 11 is a fragmentary axial section of the container of FIG. 10, with the closure loosely carried on the jar.

Still another embodiment of the invention is illustrated in FIGS. 10–12, showing a container 80a comprising a jar having a side wall 84, and a bottom wall 86. The side wall 84 has an annular sealing lip provided with a groove which can be of either rectangular or round configuration and which receives a sealing gasket 100a of resilient plastic, rubber, or elastomer composition. As in the previous embodiment, the screw cap member 94 per se, is not involved with the seal other than to press the panel member 92a into sealing engagement with the gasket 100a. The screw cap member 94 has a flange or shoulder 104 which overlies a corresponding shoulder on the panel member 92a so as to maintain the members in assembled relation. A positioning bead 110 is optionally provided, on one or the other of the shoulders.

FIG. 11 shows the gasket 100a prior to installation of the closure, and FIG. 12 illustrates the gasket 100a after it has been compressed by the panel member 92a. The latter is preferably constituted of transparent plastic, whereas the screw cap member 94 is opaque, so as to conceal from view, its own screw thread 96 as well as the thread 88 on the jar exterior.

Referring to FIGS. 10–13, and in accordance with the invention, there is provided a novel method of making a hermetically sealed jar, utilizing a unique, poured gasket. In carrying out the method, liquid gasket material is poured or injected into the lip groove uniformly, as by a nozzle 114, FIG. 13, so as to partially fill the groove. The degree of filling can be varied, to achieve different gasket thicknesses as dictated by particular applications. In practice, curing of the poured gasket can be accomplished by application of heat or ultraviolet energy, or by means of a chemical reagent or other curing methods that are per se, known in the field. The material of which the gasket is constituted may be a thermoplastic elastomer, that is, one which is constituted of a combination of plastic and rubber, or alternately a plastisol compound.

Referring again to FIGS. 10–12, by the invention the underside of the shoulder of the panel member 92*a* is provided with a depending bead 112 which overlies the gasket 100*a*, when cured, and resiliently seals therewith when the closure 90*a* is assembled to the jar. An air-tight seal is thus established between the gasket 100*a* and jar lip on the one hand, and the bead 112 on the panel member 92*a* on the other hand. The screw cap member 94 does not as such, contribute to any sealing function per se, and accordingly is generally not exposed to the contents of the jar unless the closure 90 is removed.

All of the disclosed containers thus enjoy the advantage of substantially complete freedom from leakage of product into the area around the threads, which has often been a problem in the past with other container constructions.

From the above it can be seen that we have provided novel and improved display-type containers which are both simple in their structure, and which feature improved seal characteristics that are confined essentially to a container lip, and solely one part of a two-part or composite closure, namely the central panel member portion thereof. Conventional cap liners of the type which have been employed in the past, are not required. Where the panel member is made transparent, the contents of the container can be readily viewed; also, where the screw cap member is constituted of opaque plastic, all the threads of the container are completely concealed from view, this latter feature being considered very important from the commercial standpoint.

The disclosed structures and method, are thus seen to represent a distinct advance and improvement in the dispenser field.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A container for displaying cosmetics, comprising in combination:

a) a jar having a neck portion with external threads thereon, said neck portion further having an annular lip, b) a closure member comprising a ring-shaped peripheral screw cap part having internal threads to mate with the threads of the jar neck portion, said closure member further comprising a central disk-shaped part constituted of transparent molded plastic material, to permit viewing of the jar contents, c) said screw cap part having an annular seat which overlies and bears against the periphery of the disk-shaped part, and d) cooperable sealing means on the periphery of the disk-shaped part and on the annular lip of said jar neck portion, providing a substantially air-tight seal between the disk-shaped part and annular lip when the screw cap part is tightened onto the threads of the jar neck portion, e) said peripheral portion of said screw cap part being disposed in overlying relation with said peripheral portion of said disk-shaped part, said peripheral portion of the screw cap part forcing said sealing area of the disk-shaped part into tight sealing engagement with the said sealing means, f) the upper surface of the peripheral portion of said disk-shaped part having an annular positioning groove in it, and g) the under surface of the peripheral portion of the screw cap part having an annular bead disposed in said positioning groove.

2. A container as set forth in claim 1, wherein the disk-shaped part is circular, and the periphery thereof extends radially, at all circumferential points thereof, past the innermost surface of the jar neck portion so as to overlie the same, and maintain the annular seat of the screw cap part spaced above said annular lip of the jar neck portion.

3. A container as set forth in claim 1, wherein said neck portion of the jar and said screw cap part are constituted of opaque plastic material, so as to completely conceal the threads of the jar and the threads of the screw cap part.

4. A container as set forth in claim 1, wherein:

a) the disk-shaped part and the screw cap part are constituted as two separate pieces of plastic that are joined together, and b) the upper surface of the disk-shaped part and the upper surface of the annular seat of the screw cap part forming aligned surfaces which are smooth and essentially stepless continuations of one another.

5. A container as set forth in claim 1, wherein said disk-shaped part has a peripheral portion which is sandwiched between the jar lip and the annular seat of the screw cap part when the latter is assembled to the jar.

6. A container as set forth in claim 1, wherein said disk-shaped part has a peripheral portion which is tightly clamped between the jar lip and the annular seat of the screw cap part at substantially all circumferential points on the disk-shaped part, when the screw cap part is assembled to the jar.

7. A container as set forth in claim 1, wherein:

a) said neck portion of the jar and said screw cap part are constituted of opaque plastic material, so as to completely conceal the threads of the jar and the threads of the screw cap part, b) the contents of the jar being continuously visible through the transparent disk-shaped part, at the same time that the said threads are being concealed.

8. A container for displaying cosmetics comprising, in combination:

a) a jar having a wide annular neck portion provided with an external screw thread, said neck portion having a mouth constituting a continuous sealing lip, b) a ring-shaped screw cap member that is on and cooperable with said neck portion, said ring-shaped screw cap member including a skirt having an internal screw thread that engages the said external screw thread of the neck portion and an inwardly extending peripheral portion projecting radially inwardly from said skirt, c) a plastic panel member having a top portion, a lower portion and a peripheral portion extending radially outwardly from said lower portion to define a step between said top portion and said peripheral portion, said peripheral portion being disposed within said cap member, the peripheral portion of said panel member having an underside sealing area which is engaged with the sealing lip of said neck portion, d) said peripheral portion of said ring-shaped screw cap member being disposed in overlying relation with said peripheral portion of said panel member, said overlying portion forcing said sealing area of the panel member into tight sealing engagement with the continuous sealing lip of said jar, e) said peripheral portion of the ring-shaped screw cap and said panel member having an annular bead and an annular groove which adjoins said bead and which is coextensive therewith, f) said bead and groove interlocking with each other.

* * * * *